United States Patent [19]

Dunning et al.

[11] 3,976,734

[45] Aug. 24, 1976

[54] METHOD FOR FORMING AIR FORMED ADHESIVE BONDED WEBS

[75] Inventors: Charles E. Dunning; Winterton U. Day, both of Neenah, Wis.

[73] Assignee: Kimberly-Clark Corporation, Neenah, Wis.

[22] Filed: July 7, 1975

[21] Appl. No.: 593,560

Related U.S. Application Data

[60] Continuation of Ser. No. 416,383, Nov. 16, 1973, which is a division of Ser. No. 145,485, May 20, 1971, Pat. No. 3,776,807.

[52] U.S. Cl. ..... 264/89; 264/91; 264/119; 264/121; 264/128

[51] Int. Cl.[2] ..... D04H 1/64

[58] Field of Search ..... 264/119, 128, 89, 91, 264/121

[56] References Cited

UNITED STATES PATENTS

| | | | |
|---|---|---|---|
| 2,698,574 | 1/1955 | Dougherty et al. | 264/128 |
| 2,719,806 | 10/1955 | Nottebohm | 264/128 |
| 2,986,780 | 6/1961 | Bletzinger | 264/128 |
| 3,047,444 | 7/1962 | Harwood | 264/128 |
| 3,150,416 | 9/1964 | Such | 264/128 |
| 3,692,622 | 9/1972 | Dunning | 264/119 |

*Primary Examiner*—Robert F. White
*Assistant Examiner*—T. E. Balhoff
*Attorney, Agent, or Firm*—Leydig, Voit, Osann, Mayer & Holt, Ltd.

[57] ABSTRACT

A method of forming a lightweight, airlaid web of wood fibers suitable for tissue and toweling applications comprises airlaying a wood fiber continuum onto a foraminous carrier, bringing the continuum into contact with a transfer member printed with an adhesive in a preselected pattern, the adhesive being disposed in a low viscosity fluid, and removing the fluid to provide an airlaid, adhesively bonded web.

3 Claims, 4 Drawing Figures

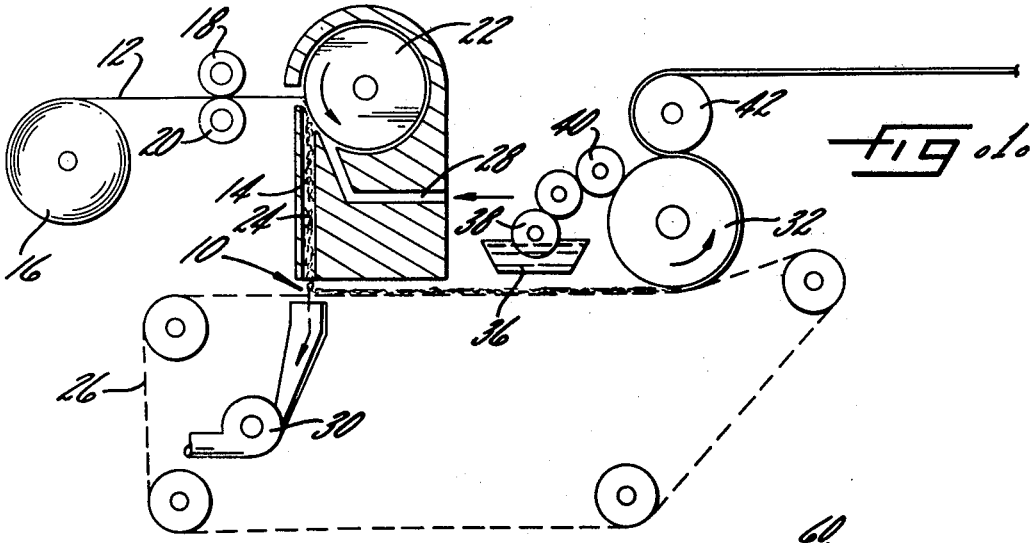
Fig. 1.
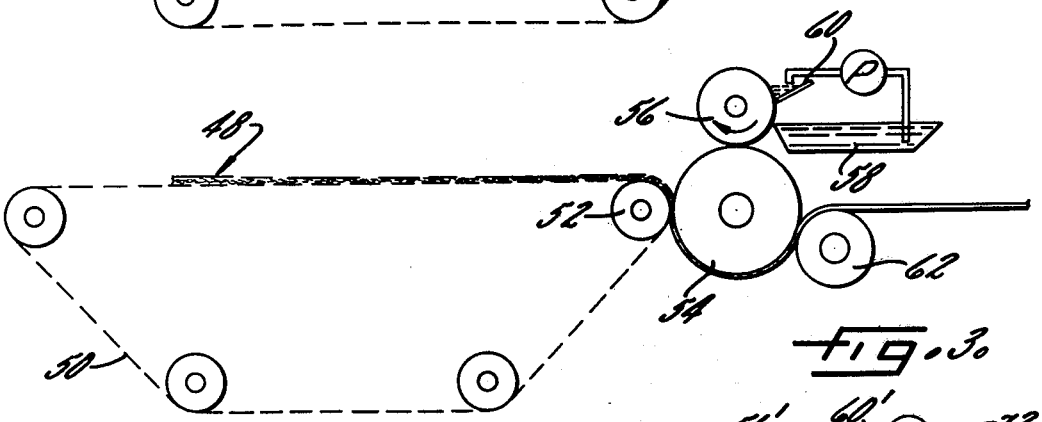
Fig. 3.
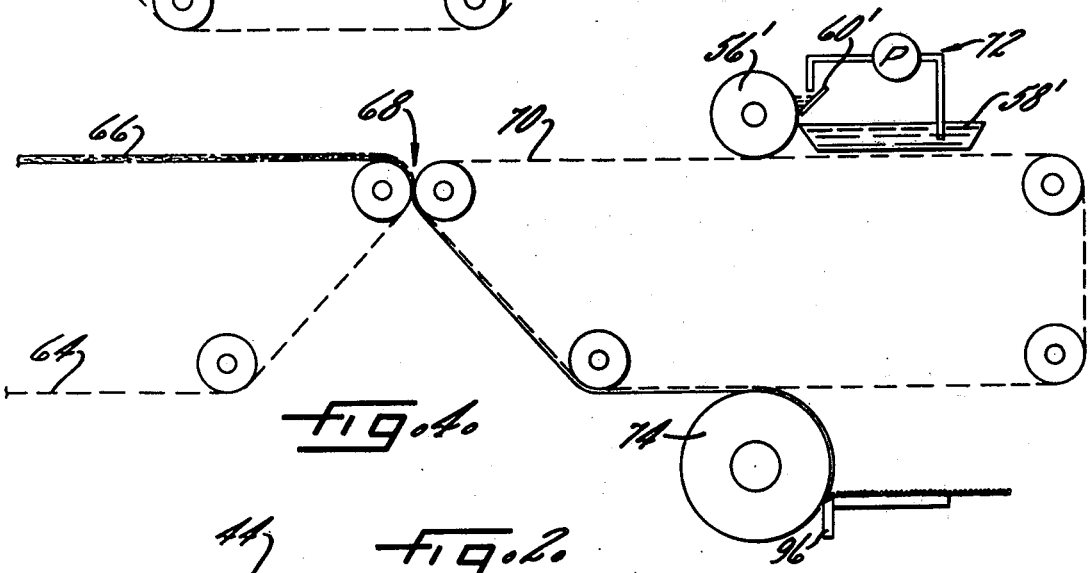
Fig. 4.
Fig. 2.
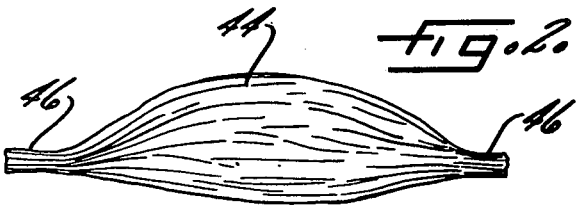

METHOD FOR FORMING AIR FORMED ADHESIVE BONDED WEBS

This is a continuation of application Ser. No. 416,383 filed Nov. 16, 1973, which application is a division of application Ser. No. 145,458, for "Air Formed Adhesive Bonded Webs and Method for Forming Such Webs", filed May 20, 1971, now U.S. Pat. No. 3,776,807.

RELATED APPLICATIONS

Dunning, Ser. No. 882,257, filed Dec. 4, 1969, for: Air Formed Web and Method for Making Such Webs, now U.S. Pat. No. 3,692,622, a continuation-in-part of Ser. No. 783,877, filed Dec. 16, 1968, now abandoned.

Dunning application Ser. No. 145,449, for: Air Formed Adhesively Supplemented, Hydrogen-Bonded Webs and Method for Making Such Webs, filed on May 20, 1971, now U.S. Pat. No. 3,764,451.

Dunning and Kellenberger applications, for: "Apparatus for Forming Airlaid Webs" Ser. No. 145,452 and "High Speed Method for Forming Airlaid Webs", Ser. No. 145,546, filed on May 20, 1971, both now abandoned.

DESCRIPTION OF THE INVENTION

The present invention relates to cellulosic products and, more particularly, to the preparation of lightweight cellulosic products useful in tissue and toweling applications which are characterized by a desirable combination of strength, absorbency, and tactile properties.

Conventionally, disposable tissue and towel products have been formed on paper-making equipment by water laying a wood pulp fiber sheet and, thereafter, removing the water either by drying or a combination of pressing and drying. During water removal, strong capillary surface tension force is developed between fibers and a degree of overall bonding inevitably results. Because of this overall bonding phenomenon, sheets prepared by waterlaid methods inherently possess very unfavorable tactile properties (e.g., — harshness, stiffness, low bulk and poor overall softness) and absorbency. To enhance these latter properties, waterlaid sheets are conventionally creped, which artificially improves the tactile and absorbency properties by disrupting the excessive fiber bonding.

However, creping has several limitations, including the fact that the detrimental effects of the initial overall bonding is not completely offset. Also, in a waterlaid method, there is typically preferential fiber orientation in the machine direction; and, as a result, the strength in this direction is always higher than in the cross direction. Consequently, achieving creped products with acceptable cross direction strengths generally requires developing excessive machine direction strength. Because of this, the attainment of optimum tactile properties is prevented.

Where products are to be used in contact with moisture such as toweling and facial tissues, it is customary to treat them with wet strength resins. The addition of such resins can detract from the tactile properties of the products.

Air forming of wood pulp fiber sheets has been carried out for many years; however, the resulting webs have only been used for applications where either little strength is required (such as for example absorbent products) or applications wherein a certain minimum strength is required but the tactile and absorbency properties are unimportant (such as various specialty papers). U.S. Pat. Nos. 2,447,161 and 2,810,940 and British Pat. No. 1,088,991 illustrate air forming techniques for such applications.

The copending related applications previously identified disclose a method, and the resulting product, of air laying a cellulosic web to provide an aesthetically pleasing cellulosic web characterized by a desirable combination of strength, absorbency and tactile properties. Such webs are made by air laying a continuum of substantially unbonded wood fibers and forming a coherent structure by bonding the fibers together at regularly patterned areas of the continuum. These webs possess a novel combination of attributes which makes them highly desirable as substitutes for conventional waterlaid paper products in a variety of disposable applications.

While the properties of such webs render them very suitable for applications such as sanitary wipes and towelings, wide spread use is contingent upon the ability to make the webs in an economic fashion. This necessitates forming the product at high speeds, desirably in excess of 1,000 ft. per minute. Operation at such speeds, however, creates a considerable variety of problems. A particularly difficult problem arises because the airlaid continuum which is formed has little integrity and yet must be subjected to a bonding step that requires removal of the flimsy material from the wire on which it was formed. Bonding, at high speeds, to provide the desired strength level and coherency of the product also creates difficulty.

Methods for forming desirable airlaid webs at high speeds are disclosed in the copending applications identified previously entitled "Apparatus for Forming Airlaid Webs", Ser. No. 145,452 and "High Speed Method for Forming Airlaid Webs", Ser. No. 145,546, both now abandoned. The procedures disclosed in these applications involve moisturizing an airlaid continuum while it is on the wire on which it was formed in order to subsequently transfer it into and out of a bonding station. The presence of such moisture requires the subsequent drying of the formed web.

It is a principal object of the present invention to provide a high speed method for forming cellulosic webs having desirable strength, absorbency and tactile properties which does not necessitate extensive drying of the web after preparation. A further and closely related object is to provide a high speed process wherein transfer of an airlaid continuum of wood fibers from its forming wire to a bonding station can be accomplished without moisturizing the web on the forming wire.

An additional object is to provide light weight, airlaid webs of wood fibers having desirable absorbency and tactile properties and which also have exceptionally high strength.

A further object is to provide adhesively spot bonded, airlaid webs of wood pulp fibers which can be prepared at high speeds and in a manner that does not require moisturizing of the web prior to the application of the adhesive thereto.

Other objects and advantages of the present invention will be apparent as the following description proceeds, taken in conjunction with the accompanying drawing in which:

FIG. 1 is a side view illustrating an arrangement of apparatus which can be used in accomplishing the present invention;

FIG. 2 is a cross-sectional view of a product prepared using the apparatus illustrated in FIG. 1; and FIGS. 3 and 4 are side elevation views of additional embodiments of apparatus which can be used in accomplishing the process of the present invention.

While the invention is susceptible of various modifications and alternative constructions, there is shown in the drawings and will herein be described in detail the preferred embodiments. It is to be understood, however, that it is not intended to limit the invention to the specific forms disclosed. On the contrary, it is intended to cover all modifications and alternative constructions falling within the spirit and scope of the invention as expressed in the appended claims.

Briefly stated, the present invention involves forming a lightweight, airlaid web of wood fibers on a moving foraminous carrier and thereafter bringing the web into contact with a transfer member moving at substantially the same speed as the carrier. The transfer member has printed on its surface, in a preselected pattern, an adhesive disposed in a liquid. On contact between the web and the moving transfer member, the liquid rapidly penetrates into the web and wets the airlaid fibers in those localized regions corresponding to the preselected pattern. Such rapid wetting temporarily unites the fibers of the web together, thus permitting transfer of the web to the transfer member without substantial disruption of the web. After transfer has been effected, bonding of the web in the preselected pattern to form a useful product can be accomplished by simply removing the liquid, generally by means of heat when the liquid is water or an easily vaporized medium.

In preparing webs as above described, it is important that the preselected pattern of liquid containing the adhesive be applied to the transfer member at discrete spots which are spaced less than an average fiber length of the cellulosic web apart. Such a pattern not only assures that the web will have sufficient integrity during transfer but also that the resulting adhesively bonded product will be sufficiently strong for most intended end uses. A suitable pattern can comprise a series of discrete spots arranged on the transfer member so that the resultant bonded web has bonded areas at a frequency of about 10-40 bonds per sq. inch across both dimensions of the web and such that the total bonded area of the web is about 10–40%. Webs so bonded not only have sufficient strength but are additionally characterized by highly desirable absorbency and tactile properties due principally to the substantial areas of the unbonded fibers existing between the particular bonded zones.

In addition to the selection of an appropriate bond pattern, it is also an important aspect of the present invention that the cellulosic web be in its "as formed" condition on contact with the printed transfer member and, in particular, that it not be substantially compacted. The use of uncompacted airlaid webs assures that the liquid printed on the transfer member will rapidly penetrate the web on contact therewith, thus providing almost instantaneous, though somewhat temporary, structural integrity to the web.

The particular adhesive employed in accomplishing the present invention is not particularly important so long as it can be applied in combination with a liquid which functions in effectuating transfer as above described and that the adhesive in its solid form, adequately bond the cellulosic web without excessive tackiness. Adhesives which can be deposited from a liquid medium in a solid, untacky condition at a temperature below or at the temperature necessary to remove the liquid are generally most desirable for use herein.

Adhesives which can be applied as aqueous dispersions or solutions are generally suitable for use herein. Examples of such materials include various starches, water soluble polymeric materials, and water dispersible resins such as various vinyl resins (e.g., polyvinyl acetate and vinyl acetate/ethylene copolymers) and acrylics. Adhesive materials such as vinyl resins dissolved in suitable organic solvents can also be employed. In addition, plastisols, i.e., polymeric materials such as vinyl polymers (e.g., vinyl chloride) and copolymers dispersed in fluid plasticizers such as diocty phthalate and the like, can also be used at suitably low viscosities. With respect to such plastisols, removal of the liquid plasticizer is accomplished by absorbing the plasticizer into the polymer particles which occurs on curing of the plastisol. In addition, hot melt adhesives can be used. Such adhesives are applied as liquids. On cooling, the liquid character thereof disappears leaving the solidified adhesive.

Turning now to the drawings, FIG. 1 illustrates one manner of practicing the present invention. As shown, a cellulosic web 10 is formed by initially separating a pulp sheet 12 into its individual fibers 14 by unwinding the pulp sheet 12 from a roll 16 and forwarding the sheet by means of the driven rolls 18,20 to a divellicating means such as a picker roll 22, powered by means not shown. The individual fibers 14 are conveyed through a forming duct 24 and onto a moving foraminous wire 26. Air from a source 28 in combination with a vacuum box 30 creates a downwardly moving stream of air which assists in collecting the air formed web 10 on the foraminous wire.

While customary air forming techniques can be utilized in forming the web, the forming duct 24 illustrated in FIG. 1 is efficient in obtaining an especially suitable web, particularly at high speeds. The illustrated duct has a width approximately equal to the height of the picker teeth on the roll 22 and is positioned so as to tangentially receive the fibers as they leave the picker. By using a duct with such a width, fiber velocity can be maintained essentially constant throughout the length of the duct. Webs formed in this manner have exceptionally good uniformity and are substantially free of fiber floccing. Appropriate sizing of the forming duct and the spatial arrangement with respect to the picker and the wire are more completely described in copending Appeal application Ser. No. 882,265, filed on Dec. 4, 1969 entitled "Pulp Picking Apparatus with Improved Fiber Forming Duct", now abandoned.

The weight of the airlaid web formed in the above-illustrated manner is dependent upon the desired end-use of the subsequently prepared product. For most applications, however, webs having a basis weight of about 5–50 lbs/2880 $ft^2$ are suitable, 10 to 25 lbs/2880 $ft^2$ being preferred. The particular type of cellulosic fibers used in preparing the web is also not critical and the type selected will generally depend upon the desired surface texture. For example, webs with a soft and fluffy texture are generally obtained from cedar fibers while a slightly more wooly texture with increased body can be obtained from southern pine fibers.

Referring again to FIG. 1, after formation on the foraminous wire 26, the surface of the web opposite the wire 26 is brought into contact with the heated transfer roll 32, which as viewed in FIG. 1, rotates in a counterclockwise direction and is moving at substantially the same speed as the wire. A slight degree of wrap of the wire 26 around the transfer roll 32 can be provided in order to aid in transfer to the roll 32.

In the illustrated embodiment, the transfer roll 32 has a plurality of raised points on its surface to which an adhesive such as above-described disposed in a liquid is applied from the pan 36 via the adhesive transfer rolls 38 and 40. The size of the raised points on the transfer roll 32 are desirably comparatively steep with heights of about 0.015–0.030.

After transfer to the roll 32, the web is conveyed on the heated surface thereof for a time sufficient to remove the liquid, thus leaving the solidified adhesive. The web can then be removed from the roll 32 by passage over the roll 42. In order to facilitate such removal, the surface of the transfer roll 32 is desirably made of an easily releasable material such as tetrafluoroethylene. Similarly, in order to aid the initial transfer of the web to the roll 32, the foraminous wire 26 can also be fashioned from an easily releasable material.

FIG. 2 illustrates a cross sectional view of a web prepared in a manner such as described with respect to FIG. 1. As shown, the web is characterized by a continuum of fibers 44 interrupted in a pattern of adhesive bonds 46. As illustrated, the adhesive bonds are highly compacted compared with the regions between bonds and, typically, the thickness of the unbonded regions will be at least several times greater than the thickness of the bond areas.

Turning now to FIG. 3, there is illustrated a further method for practicing the present invention. As shown, an airlaid web 48 formed in a manner similar to that described with respect to the web 10 of FIG. 1 is conveyed on the forming wire 50 to the nip between the roll 52 and the heated, transfer roll 54. The surface of the roll 54 is, in this embodiment, smooth and has printed thereon a pattern of liquid-borne adhesive. As illustrated, adhesive printing on the roll 54 can be accomplished by bringing the surface of the roll 54 into light pressure contact with the rubber-intaglio roll 56 which has depressions in its surface corresponding to the desired preselected adhesive pattern. Adhesive disposed in a liquid from a supply pan 58 is pumped or otherwise transferred to a reservoir located immediately above an inclined doctor blade 60 — the reservoir being defined in part by the upper surface of the inclined doctor blade and the adjacent portion of the rotating periphery of the surface of the intaglio roll 56. As the intaglio printing roll 56 rotates (in a clockwise direction as viewed in FIG. 3), the intaglio pattern surface thereof is filled with the liquid carrying the adhesive, excess liquid is removed by the doctor blade 60 and a metered amount of liquid is transferred to the transfer roll 54.

When the liquid on the surface of the transfer roll 54 contacts the web 48 at the transfer nip, the adhesive immediately penetrates the web in the preselected pattern. Such penetration with the accompanying temporary binding effect on the web 48 in combination with the preferential attraction of the liquid for the transfer roll 54 causes the web 48 to transfer, substantially intact, from the wire 50 to the transfer roll 54. With respect to effecting such transfer, the clearance in the transfer nip should be such as to permit the web 48 to come into contact with the printed liquid adhesive, but should not be so small as to cause liquid to be forced through the web to the wire 50. If liquid is forced through the web, a degree of web adherence to the wire 50 may develop and such can adversely affect web transfer to the roll 54.

After the web has been transferred to the heated roll 54 in the manner indicated, the web is maintained in contact with the roll for a time sufficient to effect solidification of the adhesive and removal of the accompanying liquid. Thereafter, the bonded web can be removed from the roll 54 over the roll 62. Preferably, as is true with respect to the previous embodiment, the surface of the roll 54 is desirably of a releasable character so that removal of the bonded web therefrom can be easily affected. Alternatively, if the roll 54 has a surface such as of steel from which the web does not easily release, the web can be removed therefrom by conventional creping techniques.

Referring now to FIG. 4, the manner illustrated therein of preparing a bonded web is quite similar to that shown in FIG. 3 except that an endless belt 70 is employed as a transfer member for the web 66, transfer being effected in the nip 68 between the airlaid web forming wire 64 and the belt 70. Printing of the adhesive onto the belt 70 can be accomplished at the printing station 72 in the manner described previously with reference to FIG. 3. Since it is difficult to maintain the belt 70 in a heated condition sufficient to solidify the adhesive and remove the liquid therefrom, the temporarily stabilized web transferred to the belt 70 at the transfer nip 68 can again be transferred to the heated roll 74 for solidification of the adhesive and removal of the liquid. In order to accomplish transfer to the roll 74, the surface of the belt 70 should contain a release coating and the web should be drawn into contact with the roll 74 by rotating the roll 74 at a speed slightly higher than the speed of the belt 70. Due to the temporarily stabilized nature of the web 66 on the belt 70, the draw necessary to effect transfer does not adversely affect the integrity of the web 66. After solidification and removal of liquid on the roll 74, the bonded web can be removed therefrom using a creping blade 96. Alternatively, the web can be removed as illustrated in FIG. 3. To do such, and as has been previously discussed with respect to other embodiments, the roll 74 is preferably fabricated from or coated with a material from which the web can be easily released.

The embodiment depicted in FIG. 4 is quite useful when hot melt adhesives are employed. In such instances the adhesive is applied in a heated, liquid form to the belt 70. By the use of a cooled roll 74, the liquid characteristics of the adhesive are removed on travel of the web in contact with the cooled roll 74 after transfer thereto.

As has been illustrated, there is herein provided a method for forming a lightweight cellulosic product useful in tissue and toweling applications. The product is formed without the necessity of an overall moisture application and thus no extensive drying is required. Due to the distinctive character of the airlaid web wherein substantial areas of unbonded fibers are present, the product has very desirable tactile and absorbency properties. In addition, due to the external adhesive nature of the web bonding, the web exhibits a surprising degree of strength.

As illustrated with respect to FIG. 2, the products of the present invention contain unbonded fiber areas interrupted by a pattern of bonded areas. When a transfer member containing raised points such as illustrated in FIG. 1 is employed, the bonded areas will be compacted so that the thickness of the unbonded areas will be several times that of the bonded areas. Such a distinctive character can also be achieved by other means. One such means involves using slight pressure in effecting transfer of the web to a smooth transfer member. Such pressure initially compacts the web over all of its surface area; however, on release of the pressure those regions not printed with fluid spring back to their substantially uncompacted state, the printed regions remaining compacted. Such a distinctive web character is also obtained when the liquid in which the adhesive is disposed has the capacity for softening the wood fibers of the web. Water is the most noticeable example of such liquids. The surface tension forces accompanying the removal of water compact the web in those preselected regions of application thus yielding an adhesively bonded web containing the previously described distinctive compacted and bonded regions.

We claim as our invention:

1. A method of forming a continuous airlaid web of wood pulp fibers of a basis weight of about 5–50 lbs./2880 ft.$^2$ and having a three-dimensional fiber continuum interrupted by a pattern of bonded fiber areas, which method comprises:

a. air laying wood pulp fibers onto a moving foraminous carrier to form a continuous three-dimensional continuum of substantially dry and uncompacted randomly deposited fibers, b. transferring the dry, uncompacted continuum from the carrier by contacting the surface of the continuum which is away from the carrier with a transfer member moving at substantially the same speed as the carrier and having adhesive disposed in a liquid printed on the surface thereof in a preselected pattern of discrete spots which are spaced less than an average fiber length apart, while supporting the continuum on the carrier and causing the liquid to penetrate the continuum, the clearance between the transfer member and the carrier being sufficient that the liquid penetrates the continuum without being forced through the continuum to the carrier side thereof, such penetration with the temporary binding effect on the continuum in combination with the preferential attraction of the liquid for the transfer member causing the continuum to transfer, substantially intact, from the carrier to the transfer member, and c. bonding said continuum by removing the liquid and leaving said adhesive while continuing to support the continuum until the adhesive bonds the fibers at the discrete spots of the preselected pattern.

2. A method according to claim 1 of forming a lightweight, airlaid web of wood pulp fibers having bonded fiber areas where in step (c) the continuing support of the continuum is by a roll which is heated to remove the liquid, and which includes step (d) creping the continuum to remove the continuum from the heated roll.

3. A method of forming a continuous airlaid web of wood pulp fibers of a basis weight of about 5–50 lbs./2880 ft.$^2$ and having a three-dimensional fiber continuum interrupted by a pattern of bonded fiber areas, which method comprises:

a. air laying wood pulp fibers onto a moving foraminous carrier to form a continuous three-dimensional continuum of substantially dry and uncompacted randomly deposited fibers, b. transferring the dry, uncompacted continuum from the carrier by contacting the surface of the continuum which is away from the carrier with a transfer roll having a patterned surface moving at substantially the same speed as the carrier and carrying adhesive disposed in a liquid on the raised areas of the pattern on the surface thereof which are spaced less than an average fiber length apart, while supporting the continuum on the carrier and causing the liquid to penetrate the continuum, the clearance between the transfer roll and the carrier being sufficient that the liquid penetrates the continuum without being forced through the continuum to the carrier side thereof, such penetration with the temporary binding effect on the continuum in combination with the preferential attraction of the liquid for the transfer roll causing the continuum to transfer, substantially intact, from the carrier to the transfer roll and c. bonding said continuum by removing the liquid while leaving said adhesive while continuing to support the continuum until the adhesive bonds the fibers at the discrete areas of the pattern.

* * * * *